US012186797B2

(12) United States Patent
D'Souza et al.

(10) Patent No.: US 12,186,797 B2
(45) Date of Patent: Jan. 7, 2025

(54) METHOD OF MANUFACTURING A COMPONENT

(71) Applicant: ROLLS-ROYCE PLC, London (GB)

(72) Inventors: Neil D'Souza, Derby (GB); Kevin Goodwin, Ilkeston (GB); John D Lehane, Derby (GB); Martin R Perry, Derby (GB)

(73) Assignee: ROLLS-ROYCE PLC, London (GB)

( * ) Notice: Subject to any disclaimer, the term of this patent is extended or adjusted under 35 U.S.C. 154(b) by 0 days.

(21) Appl. No.: 18/667,726

(22) Filed: May 17, 2024

(65) Prior Publication Data

US 2024/0399445 A1 Dec. 5, 2024

(30) Foreign Application Priority Data

Jun. 5, 2023 (GB) ..... 2308344

(51) Int. Cl.

| | |
|---|---|
| ***B22C 9/04*** | (2006.01) |
| ***B22C 7/02*** | (2006.01) |
| ***B22D 25/06*** | (2006.01) |
| ***B22D 27/20*** | (2006.01) |

(52) U.S. Cl.

CPC ..... *B22C 9/043* (2013.01); *B22C 7/02* (2013.01); *B22D 25/06* (2013.01); *B22D 27/20* (2013.01)

(58) Field of Classification Search

CPC ..... B22C 9/043; B22C 7/02; B22D 25/06; B22D 27/20; B22D 27/04; B22D 27/045

See application file for complete search history.

(56) References Cited

U.S. PATENT DOCUMENTS

| | | | | |
|---|---|---|---|---|
| 6,497,272 | B1 | 12/2002 | Maslen | |
| 2007/0125299 | A1* | 6/2007 | D'Souza | F01D 5/28 117/82 |
| 2017/0216912 | A1 | 8/2017 | Tennant et al. | |

FOREIGN PATENT DOCUMENTS

| | | | |
|---|---|---|---|
| CN | 104439077 | A | 3/2015 |
| JP | H11-207451 | A | 8/1999 |

OTHER PUBLICATIONS

Dec. 18, 2023 Search Report issued in British Patent Application No. 2308344.7.

(Continued)

*Primary Examiner* — Kevin P Kerns
*Assistant Examiner* — Steven S Ha
(74) *Attorney, Agent, or Firm* — Oliff PLC

(57) ABSTRACT

A method of manufacturing a component includes forming a mould assembly including an initial mould unit, providing a seed crystal including a primary growth direction, determining an optimal angular orientation of the unit, rotating the unit to dispose the unit's optimal angular orientation, encasing the unit in a refractory material, and forming a refractory mould unit having a component mould including a mould wall defining a mould cavity, and a seed holder. In the optimal angular orientation, the seed crystal's primary growth direction is angled away from the wall, thereby forming a converging disposition with the wall in a of the wall's first region facing the central sprue and a diverging disposition with the wall in the wall's second region facing a mould heater. The method includes receiving the seed crystal within the seed holder and filling the mould cavity with molten castable material to form the component.

7 Claims, 8 Drawing Sheets

(56) References Cited

OTHER PUBLICATIONS

N. D'souza et al. "Seeding of Single-Crystal Superalloys—Role of Constitutional Undercooling and Primary Dendrite Orientation on Stray-Grain Nucleation and Growth". Metallurgical and Materials Transactions B, Oct. 2005, vol. 36B, pp. 657-666.
X.L. Yang, et. al, "Microscale simulation of stray grain formation in investment cast turbine blades". Materials Science & Engineering A 386., 129-139, 2004.
M. Long, et. al, "A new experimental and simulation methodology for prediction of recrystalization in Ni-based single crystal superalloys during investment casting". Journal of Materials Processing Tech., 306, 117624, 2002.
Oct. 31, 2024 Extended Search Report issued in European Patent Application No. 24175733.5.

* cited by examiner

METHOD OF MANUFACTURING A COMPONENT

CROSS-REFERENCE TO RELATED APPLICATIONS

This specification is based upon and claims the benefit of priority from United Kingdom patent application number GB 2308344.7 filed on Jun. 5, 2023, the entire contents of which is incorporated herein by reference.

BACKGROUND

1. Field of the Disclosure

The present disclosure relates to a gas turbine engine, and a method of manufacturing a component that may be associated with the gas turbine engine.

2. Description of the Related Art

Certain articles and components, such as aerofoil blades for gas turbine engines, are preferably formed with known crystallography in order to achieve desired operational performance. For example, a desired crystallography may allow the components to be more resistant to high temperature creep. A number of methods have been identified for forming single crystal components. Such methods generally utilise a seed crystal to initiate crystal formation in the component within a mould. What is generally required is a mechanism to ensure that the desired crystallography is achieved. However, conventional methods have disadvantages in attempting to successfully circumvent hazards with respect to stray grain nucleation in growth.

The occurrence of stray grains in single crystal castings is detrimental and needs to be avoided, which requires a very tight specification to being adhered to. Such stray grains are typically located proximate to a surface of the cast component. Further, the stray grains in such regions invariably bear an orientation relationship with the primary single crystal grain and are not randomly nucleated.

SUMMARY

According to a first aspect, there is provided a method of manufacturing a component. The method includes forming a mould assembly including a central sprue extending along a central axis and an initial mould unit including a wax pattern and a seed section connected to the wax pattern. The wax pattern is made of a wax material and the seed section is made of a plastic material. The initial mould unit extends along a unit axis parallel to the central axis. The initial mould unit is rotatable about the unit axis with respect to the central sprue. The method further includes providing a seed crystal including a primary growth direction. The method further includes determining an optimal angular orientation of the initial mould unit about the central axis relative to the central sprue if the primary growth direction of the seed crystal is disposed at a predetermined orientation with respect to the initial mould unit. The method further includes rotating the initial mould unit about the unit axis, such that the initial mould unit is disposed in the optimal angular orientation relative to the central sprue. The method further includes encasing the initial mould unit in a refractory material after disposing the initial mould unit in the optimal angular orientation relative to the central sprue. The method further includes removing the wax material and the plastic material to form a refractory mould unit extending along the unit axis. The refractory mould unit includes a component mould corresponding to the wax pattern and a seed holder corresponding to the seed section. The component mould includes a mould wall defining a mould cavity that is disposed in fluid communication with the seed holder and the central sprue. Each of the component mould and the seed holder is made of the refractory material. The refractory mould unit is disposed in the optimal angular orientation relative to the central sprue. In the optimal angular orientation of the refractory mould unit, the primary growth direction of the seed crystal is angled away from the mould wall, thereby forming a converging disposition with the mould wall in a first region of the mould wall facing the central sprue and a diverging disposition with the mould wall in a second region of the mould wall facing a mould heater. The method further includes receiving the seed crystal within the seed holder, such that the primary growth direction of the seed crystal forms the converging disposition with the mould wall in the first region of the mould wall and the diverging disposition with the mould wall in the second region of the mould wall. The method further includes filling, via the central sprue, the mould cavity with molten castable material to form the component as a single crystal structure.

Due to the positioning of the initial mould unit in the optimal angular orientation, the primary growth direction of the seed crystal is angled away from the mould wall, thereby forming the converging disposition with the mould wall in the first region facing the central sprue, which may reduce a probability of formation of secondary grains. In some examples, due to the converging disposition with the mould wall in the first region, any deformation of the dendrites close to the liquidus isotherms leading to a secondary grain is stabilized because such bent/twisted dendrites constituting a secondary grain are easily overgrown by primary dendrites of the main grain, which reduces the probability of secondary grain formation and growth. At the diverging mould wall, although deformation of secondary dendrites can also occur, the shape of the isotherms (downward sloping) also stabilises the growth of the primary dendrites of the main grain over those of the secondary grains. Thus, the method of obtaining the optimal angular orientation of the initial mould unit for any blade geometry may minimise the formation and subsequent stabilisation of secondary grains, thereby reducing a possibility of non-conformance to the specifications of the component.

In some embodiments, determining the optimal angular orientation of the initial mould unit includes a) determining, using a thermal model, curvatures of a plurality of liquidus isotherms of the molten castable material as a function of time along the unit axis for a given angular orientation of the initial mould unit with respect to the central sprue. Further, determining the optimal angular orientation of the initial mould unit further includes b) determining, using the thermal model, a disposition of the primary growth direction of the seed crystal for the given angular orientation if a normal to at least one liquidus isotherm from the plurality of liquidus isotherms is inclined to the unit axis by an angle greater than 15 degrees and if the at least one liquidus isotherm slopes upwards towards an upper end of the component mould. Furthermore, determining the optimal angular orientation of the initial mould unit further includes c) repeating steps a) and b) by varying the given angular orientation till the optimal angular orientation is obtained. In the optimum orientation, a number of instances where the normal to at least one liquidus isotherm from the plurality of liquidus isotherms is inclined to the unit axis by the angle greater than 15 degrees is minimum and a number of instances where at least one liquidus isotherm slopes upwards towards the upper end of the component mould is minimum. Thus, from amongst a multitude of possible angular orientations obtained iteratively through theoretical rotation of the initial mould unit on the carousel and calculations of the curvatures of the liquidus isotherms using the thermal model, the optimal angular orientation of the initial mould unit can be deduced which may reduce the probability of formation of secondary grains.

In some embodiments, the method further includes determining that the primary growth direction of the seed crystal is independent of an orientation of the initial mould unit. The method further includes removing the wax material and the plastic material to form the refractory mould unit extending along the unit axis without rotating the initial mould unit to the optimal angular orientation relative to the central sprue. The method further includes receiving the seed crystal within the seed holder, such that the primary growth direction of the seed holder is from 0 degree to 4 degrees with respect to the unit axis. Thus, when no preferred primary (axial) and secondary (azimuthal) orientation is required for the component, the primary growth direction of the seed holder may be between 0 degree and 4 degrees with respect to the unit axis which may reduce the formation of secondary grains and reduce non-conformance.

In some embodiments, the method further includes positioning the initial mould unit on a carousel including the central sprue prior to rotating the initial mould unit about the unit axis. Specifically, the initial mould unit is positioned on the carousel such that the initial mould unit may be rotated to the optimal angular orientation.

In some embodiments, the refractory material is a ceramic slurry. The ceramic slurry is configured to coat the wax pattern and the seed section.

In some embodiments, the wax pattern and the seed section are formed as a single integral component. Thus, the wax pattern and the seed section may be rotated together to dispose the initial mould unit in the desired optimal angular orientation.

In some embodiments, the component is a blade of a gas turbine engine. The blade manufactured by the method of the first aspect may have reduced surface defects and may have improved conformance to the specifications of the blade. Thus, the blade may achieve desired operational performance due to conformance to the specifications.

According to a second aspect, there is provided a component for a gas turbine engine manufactured according to the method of the first aspect. The component manufactured by the method of the first aspect may have reduced surface defects and may have improved conformance to the specifications of the component. Thus, the component may achieve desired operational performance due to conformance to the specifications As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed). The gearbox may be a reduction gearbox (in that the output to the fan is a lower rotational rate than the input from the core shaft). Any type of gearbox may be used.

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. The bypass duct may be substantially annular. The bypass duct may be radially outside the engine core. The radially outer surface of the bypass duct may be defined by a nacelle and/or a fan case.

Specific thrust of an engine may be defined as the net thrust of the engine divided by the total mass flow through the engine. At cruise conditions, the specific thrust of an engine described and/or claimed herein may be less than (or in the order of) any of the following: 110 Nkg-1s, 105 Nkg-1s, 100 Nkg-1s, 95 Nkg-1s, 90 Nkg-1s, 85 Nkg-1s or 80 Nkg-1s. The specific thrust may be in an inclusive range bounded by any two of the values in the previous sentence (i.e., the values may form upper or lower bounds), for example in the range of from 80 Nkg-1s to 100 Nkg-1s, or 85 Nkg-1s to 95 Nkg-1s. Such engines may be particularly efficient in comparison with conventional gas turbine engines.

A fan blade and/or aerofoil portion of a fan blade described and/or claimed herein may be manufactured from any suitable material or combination of materials. For example, at least a part of the fan blade and/or aerofoil may be manufactured at least in part from a composite, for example a metal matrix composite and/or an organic matrix composite, such as carbon fibre.

The fan of a gas turbine as described and/or claimed herein may have any desired number of fan blades, for example 14, 16, 18, 20, 22, 24 or 26 fan blades.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying FIG.s. Further aspects and embodiments will be apparent to those skilled in the art.

Figure 1:
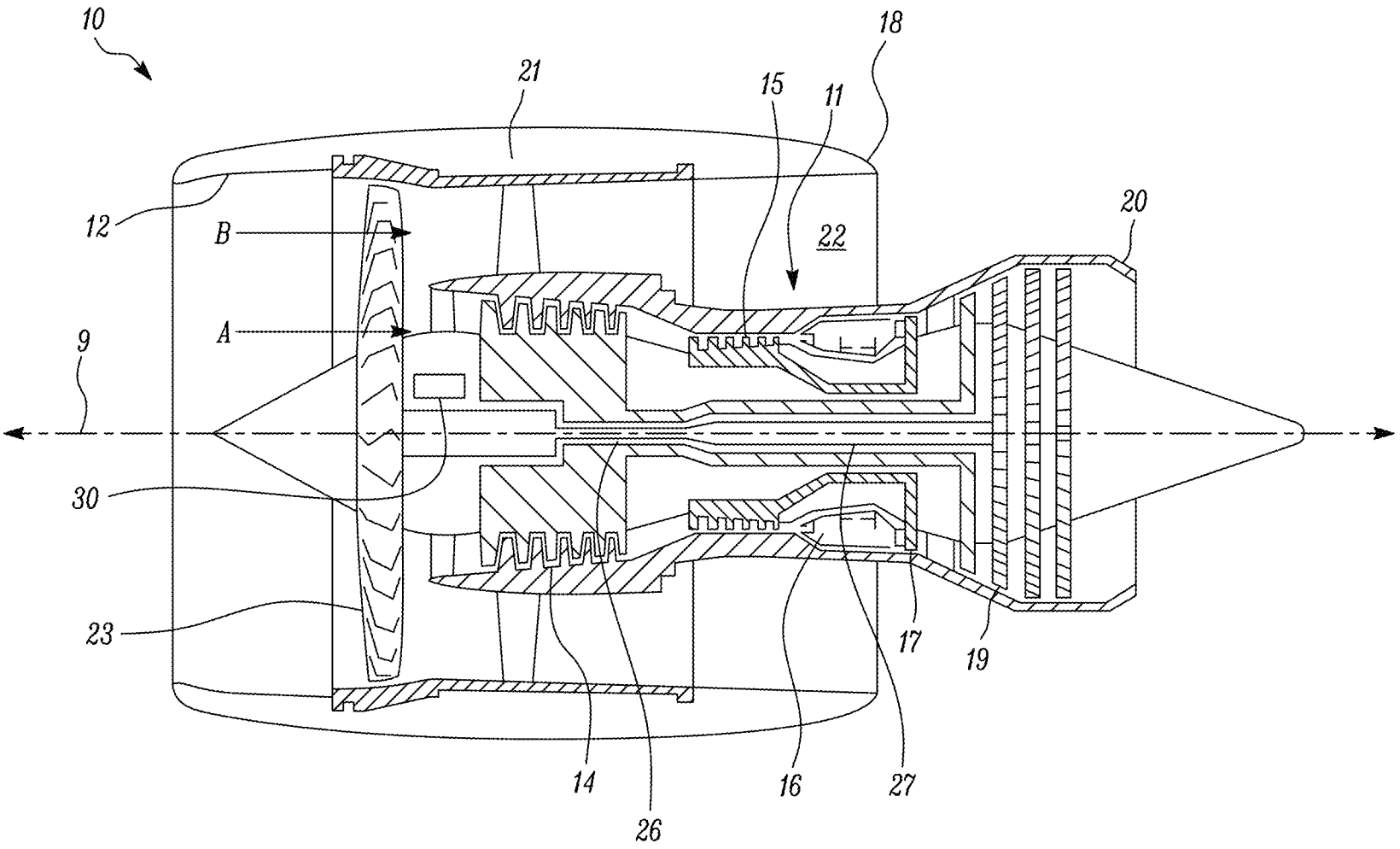
FIG. 1 is a sectional side view of a gas turbine engine, according to an embodiment of the present disclosure.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises an engine core 11 that receives the core airflow A. The engine core 11 comprises, in axial flow series, a low pressure compressor 14, a high pressure compressor 15, a combustion equipment 16, a high pressure turbine 17, a low pressure turbine 19, and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the core exhaust nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Note that the terms "low pressure turbine" and "low pressure compressor" as used herein may be taken to mean the lowest pressure turbine stages and lowest pressure compressor stages (i.e., not including the fan 23) respectively and/or the turbine and compressor stages that are connected together by the interconnecting shaft 26 with the lowest rotational speed in the engine 100 (i.e., not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core exhaust nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial, and circumferential directions are mutually perpendicular.

In addition, the present disclosure is equally applicable to aero gas turbine engines, marine gas turbine engines, and land-based gas turbine engines.

Figure 2:
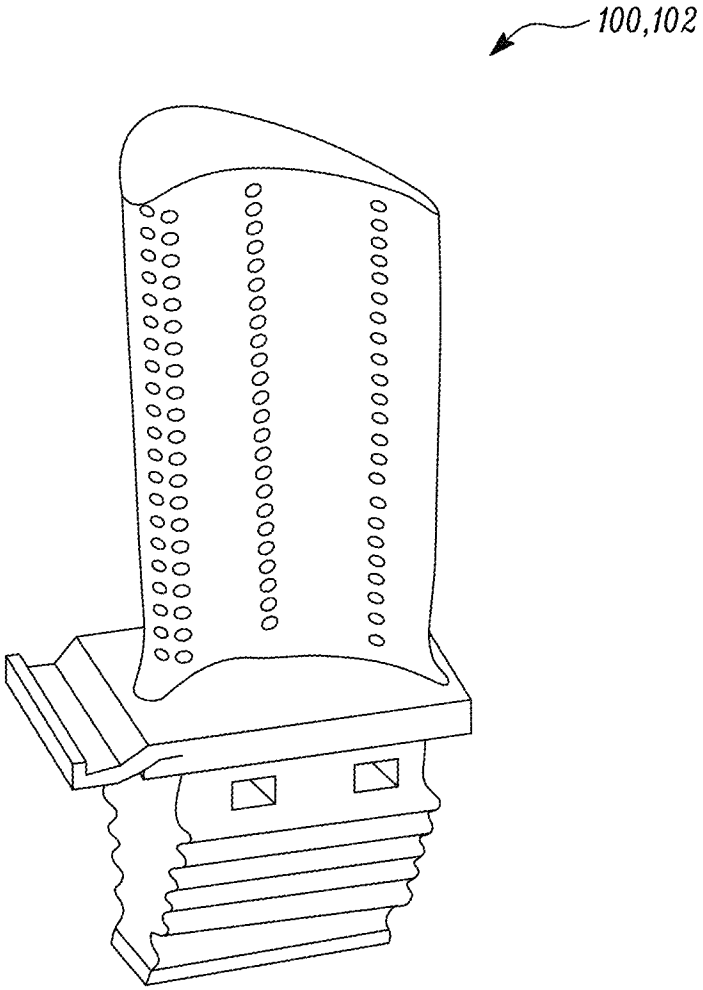
FIG. 2 is a schematic perspective view of a component associated with a turbine of the gas turbine engine of FIG. 1, according to an embodiment of the present disclosure.

FIG. 2 shows a perspective view of a component 100 associated with the gas turbine engine 10 (see FIG. 1). In the illustrated embodiment of FIG. 2, the component 100 is a blade 102 of the gas turbine engine 10. The blade 102 may be associated with any of the turbines 17, 19 (see FIG. 1). In other examples, the component 100 may include any other article, without any limitations. The component 100 is embodied as a single crystal component herein. Further, the component 100 may include a desired or predetermined crystallography.

An objective with regard to producing components with a predetermined or desired crystallography is to ensure that initiation and propagation of stray grain growth is inhibited or limited. In accordance with certain aspects of the present disclosure, a system 400 (shown in FIG. 4) is provided for forming components and articles which is independent of nucleation propensity for stray grains at and above a crystal seed melt-back level in comparison with prior methods of formation of single crystal component.

Figure 3:
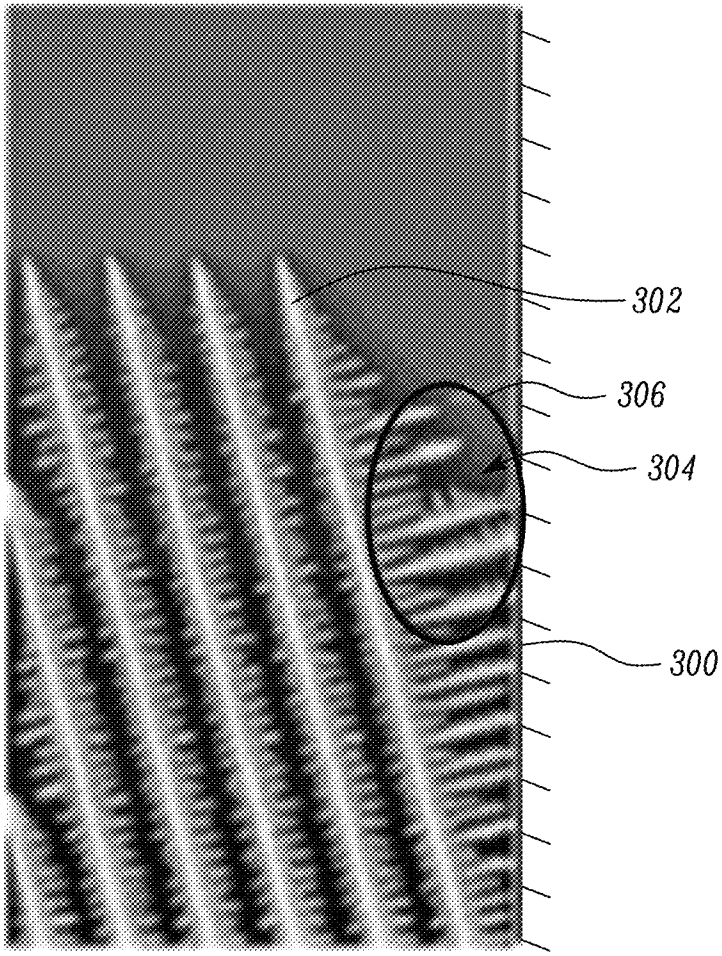
FIG. 3 illustrates dendritic crystal growth from an exemplary wall of a refractory mould, according to an embodiment of the present disclosure.

FIG. 3 is a photographic micro-structural cross-section illustrating dendritic growth of stray grains. Specifically, FIG. 3 illustrates nucleation of stray grains that occur when the local solutol under-cooling exceeds the critical nucleation under-cooling and, therefore, is associated with the transient at a mould wall 300. Nucleation occurs at or behind primary dendrite tips 302 driven by under-cooling considerations.

When considering the dendritic growth characteristics subsequent to nucleation, it will be noted that the dendrites begin to grow into a constitutionally under-cooled liquid ahead of the tips 302. The growth characteristics of the single crystal dendrites are dependent on the inclination of the off-axial dendrites in relation to the mould wall 300. This is due to the effects and implications of under-cooling associated with the solute pile-up in the vicinity of the tips 302 and the volume of liquid available, that is to say at the converging/diverging grooves at the mould wall 300.

As shown in FIG. 3, only in the case of a diverging disposition of a primary growth direction D1 (shown in FIG. 6) of a seed crystal 428 (shown in FIG. 5) with the mould wall 300, there exists an extensive network of secondary arms 304 that can potentially act as sites where deformation accumulates and leads to bending of these secondary arms 304 at their roots. However, the most important aspect relates to stability of tertiary arms emanating from a bent secondary arm 304, that can grow competitively. Only when the tertiary arms escape the solute field of the neighboring dendrite network, can a tertiary arm grow stably and successively branch and also extend across the cross-section giving rise to a secondary grain of finite size that may cause defects and non-conformance in the final component, which is not desirable. A region 306 where secondary grains may be formed is illustrated in FIG. 3.

The system 400 for manufacturing the component 100 that addresses the above mentioned shortcomings will now be explained in relation to FIGS. 4 to 7.

Figure 4:
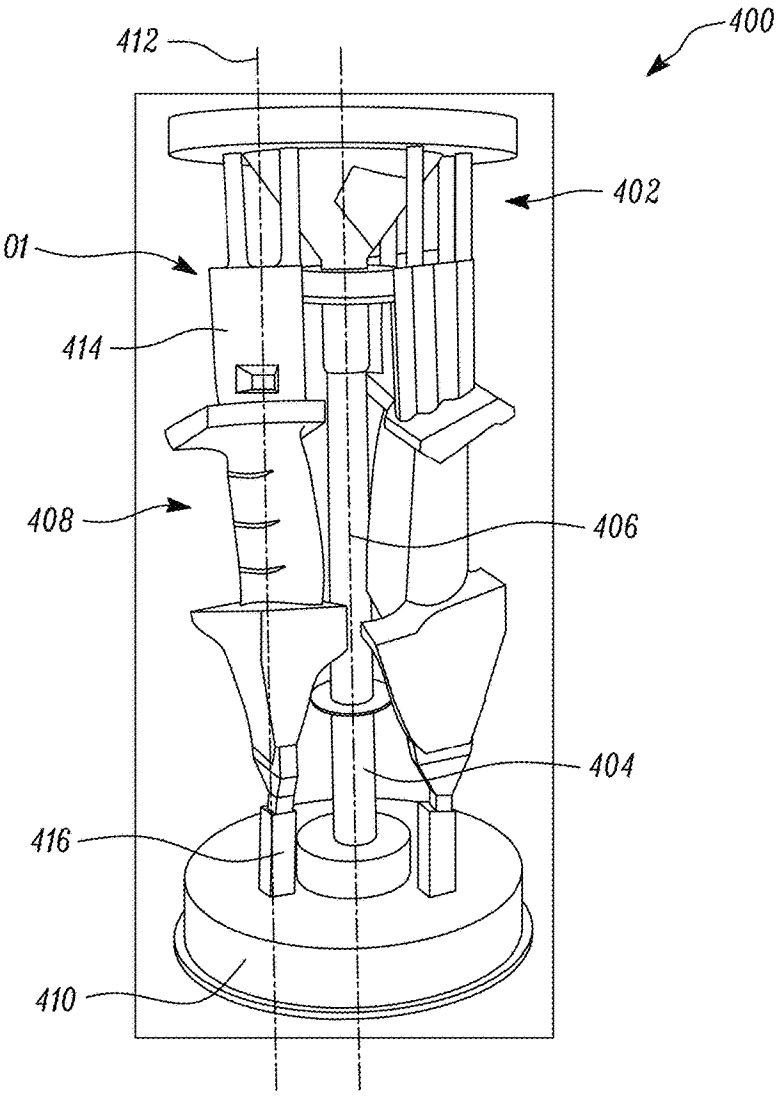
FIG. 4 is a schematic perspective view of an initial mould unit for manufacturing the component of FIG. 2, according to an embodiment of the present disclosure.

Referring to FIG. 4, the system 400 includes a mould assembly 402 including a central sprue 404 extending along a central axis 406 and an initial mould unit 408. Further, the initial mould unit 408 is positioned on a carousel 410 of the system 400. The carousel 410 includes the central sprue 404. The initial mould unit 408 extends along a unit axis 412 parallel to the central axis 406. Further, the initial mould unit 408 is rotatable about the unit axis 412 with respect to the central sprue 404. In the illustrated embodiment of FIG. 4, the carousel 410 is configured to hold four initial mould units 408 (two of which are obstructed from view in FIG. 4). Alternatively, the carousel 410 may hold any number of initial mould units 408 depending on a diameter of the carousel 410, without any limitations. The initial mould unit 408 includes a wax pattern 414 and a seed section 416 connected to the wax pattern 414. Accordingly, the wax pattern 414 and the seed section 416 may be together rotated about the unit axis 412 with respect to the central sprue 404.

Further, the wax pattern 414 is made of a wax material and the seed section 416 is made of a plastic material. Further, the wax pattern 414 and the seed section 416 are formed as a single integral component herein. Specifically, the wax pattern 414 may be formed along with the seed section 416 within a die, as the single integral component. In an example, the wax pattern 414 and the seed section 416 may be manufactured using an injection moulding process. A technique for manufacturing mould units wherein the wax pattern 414 and the seed section 416 are formed as a single integral component has been described in U.S. Pat. No. 7,204,294 B2 assigned to Rolls Royce PLC and U.S. Pat. No. 7,449,063 B2 assigned to Rolls Royce PLC, the contents of which are incorporated herein in their entirety.

Figure 5:
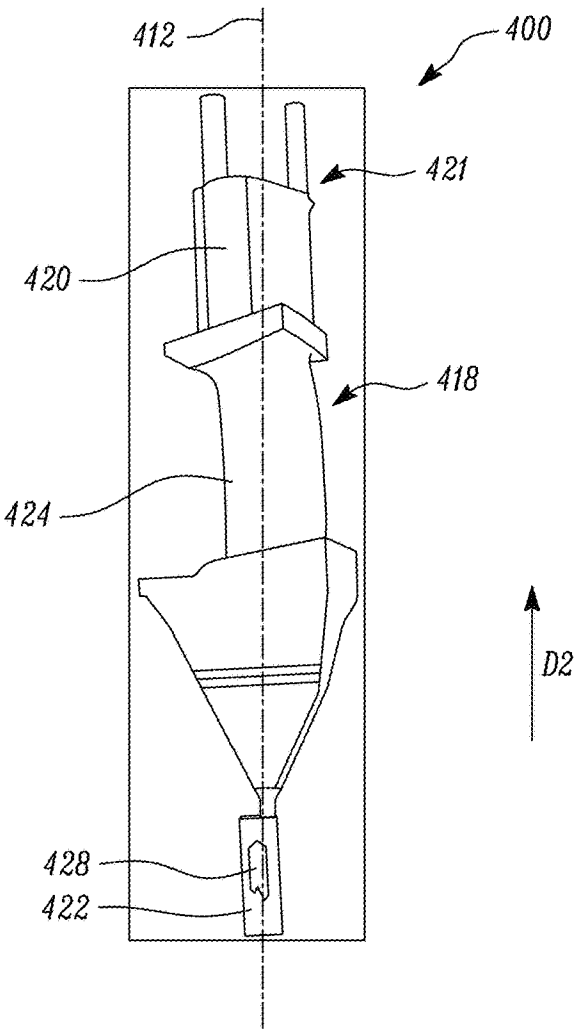
FIG. 5 is a schematic perspective view of a refractory mould unit for manufacturing the component of FIG. 2, according to an embodiment of the present disclosure.

Referring now to FIG. 5, the system 400 includes a refractory mould unit 418 extending along the unit axis 412. The refractory mould unit 418 includes a component mould 420 corresponding to the wax pattern 414 (see FIG. 4) and a seed holder 422 corresponding to the seed section 416 (see FIG. 4). The component mould 420 includes a mould wall 424 defining a mould cavity 426 (see FIG. 6) that is disposed in fluid communication with the seed holder 422 and the central sprue 404 (see FIG. 4). Each of the component mould 420 and the seed holder 422 is made of a refractory material. Specifically, the refractory mould unit 418 is formed by encasing the initial mould unit 408 (see FIG. 4) in the refractory material. The refractory material is a ceramic slurry. In an example, the ceramic slurry may include binding agents and mixtures of zircon ($ZrSiO_4$), alumina ($Al_2O_3$), and silica ($SiO_2$). Further, the wax material and the plastic material are removed to form the refractory mould unit 418. In an example, the initial mould unit 408 is melted to remove the wax material and the plastic material. Further, the mould wall 424 includes a first region 425 (shown in FIG. 6) facing the central sprue 404 (see FIGS. 4 and 6). More particularly, the first region 425 may be defined as a portion of the mould wall 424 that is in direct line of sight of the central sprue 404 and closest in proximity to the central sprue 404. The mould wall 424 also includes a second region 427 (shown in FIG. 6). The second region 427 is distant from the central sprue 404.

Thus, the refractory mould unit 418 includes an investment shell produced by coating the initial mould unit 408 with the refractory material. In some examples, multiple coatings of the refractory material may be provided on the initial mould unit 408 until a desired thickness of the refractory mould unit 418 is obtained. Further, the refractory mould unit 418 may be baked to build its strength. A first step in this direction may include subjecting the refractory mould unit 418 to a temperature just sufficient to melt out the wax material and the plastic material. In some examples, a steam autoclave may be used to melt the wax material and the plastic material.

Further, the refractory mould unit 418 is subjected to higher temperatures. After preheating and degassing, the refractory mould unit 418 may be ready to receive a seed crystal 428 and a supply of molten castable material to form the component 100 (see FIG. 2) as a single crystal structure. The seed crystal 428 is used to initiate crystal forming to manufacture the component 100. The seed crystal 428 includes the primary growth direction D1 (shown in FIG. 6). The primary growth direction D1 is an axial direction. The seed crystal 428 also includes a secondary growth direction (not shown). The secondary growth direction is an azimuthal direction. The primary growth direction D1 and the secondary growth direction may be determined from two fundamental Euler angles.

The seed crystal 428 is received within the seed holder 422. Further, the mould cavity 426 is filled with the molten castable material to form the component 100 as the single crystal structure. Further, a mould heater 430 (shown in FIG. 6) is adapted to heat the refractory mould unit 418. The mould heater 430 may include a furnace. The mould heater 430 is configured to face the second region 427 (shown in FIG. 6) of the mould wall 424. More particularly, the second region 427 may be defined as a portion of the mould wall 424 that is in direct line of sight of the mould heater 430 and closest in proximity to the mould heater 430. A runner (not shown) of the system 400 may fluidly communicate the central sprue 404 with the mould cavity 426. Thus, the molten castable material may be directed towards the mould cavity 426 via the central sprue 404 and the runner. In an example, the molten castable material may be poured under vacuum conditions, at high temperatures. After solidification is complete, the refractory mould unit 418 may be removed mechanically, while any internal ceramic cores used to produce internal cooling passages may be removed by chemical means, for example, using a high-pressure autoclave.

It should be noted that the system 400 may include other components (not shown herein), such as, a chill plate. The chill plate may be adapted to cool the seed crystal 428 and the bottom of the refractory mould unit 418 so as to assist in progressive solidification of the molten castable metal from the seed crystal 428 towards the opposite extremity of the refractory mould unit 418, i.e., in a direction D2. A temperature of the chill plate is preferably maintained such that the growth of dendrites begin at a lower end of the component mould 420, and the solidification front travels upward through the component mould 420 along the direction D2.

Referring to FIGS. 4 and 5, it was observed that an angular orientation of the wax pattern 414 in fluid communication with the seed portion 416 on the initial mould unit 408 about the central axis 406, and therefore a position of the refractory mould unit 418, is crucial in reducing a formation of secondary grains. Thus, the present disclosure is directed towards determination of an optimal angular orientation O1 of the wax pattern 414 in fluid communication with the seed portion 416 on the initial mould unit 408 about the central axis 406 relative to the central sprue 404 if the primary growth direction D1 of the seed crystal 428 is disposed at a predetermined orientation with respect to the initial mould unit 408. In an example, the predetermined orientation may be a preferred/fixed axial and azimuthal orientation. Further, the optimal angular orientation O1 may correspond to an optimal position of the wax pattern 414 in fluid communication with the seed portion 416 on the initial mould unit 408 about the central axis 406 of the central sprue 404. The optimal angular orientation O1 is determined offline using a thermal model.

Figure 6:
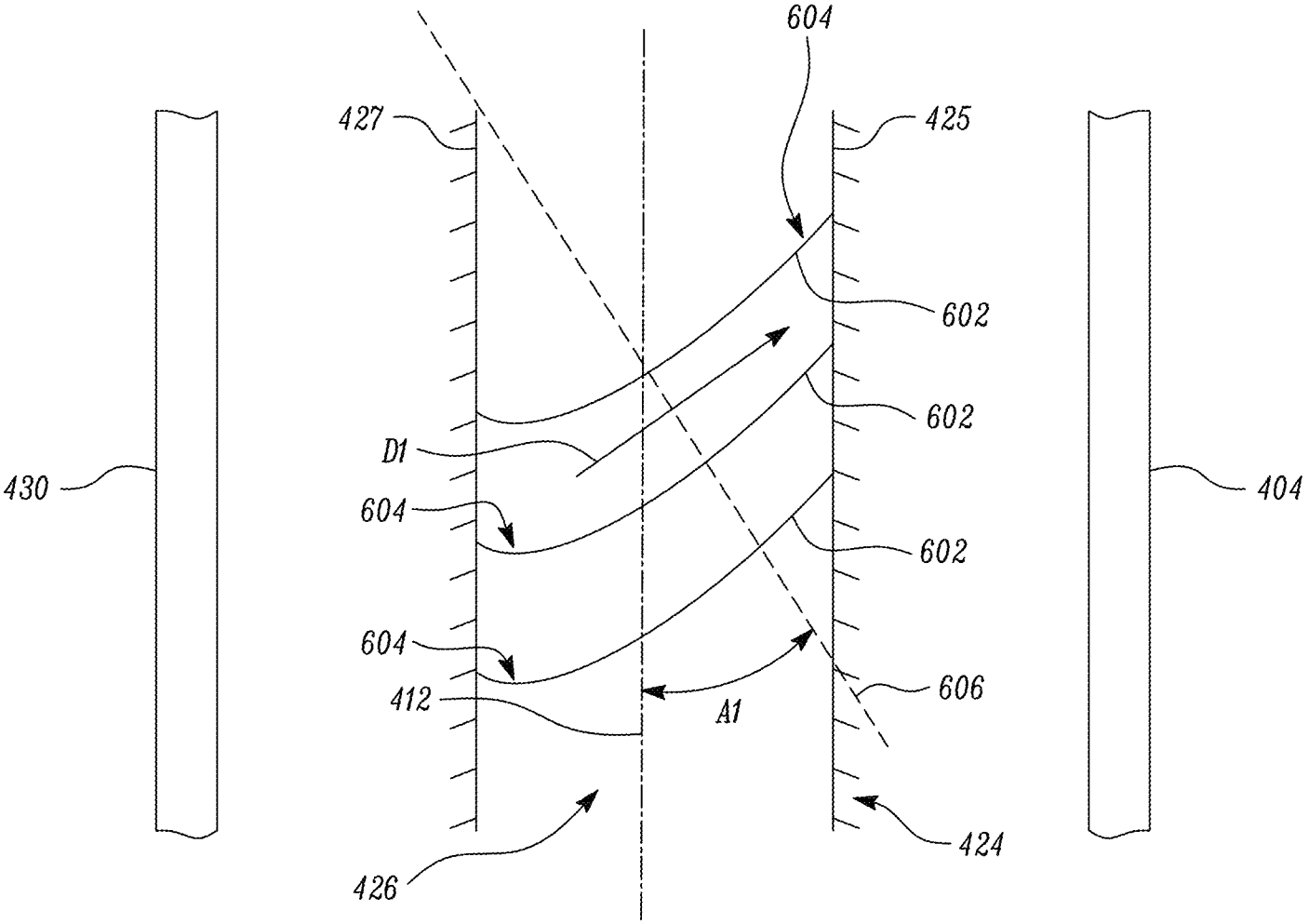
FIG. 6 is a schematic view illustrating a relationship between a liquidus isotherm and a primary growth direction of a seed crystal, according to an embodiment of the present disclosure.

Referring now to FIG. 6, in order to determine the optimal angular orientation O1 (see FIG. 4) of the initial mould unit 408 (see FIG. 4), the thermal model may be used to determine curvatures 602 of a plurality of liquidus isotherms 604 of the molten castable material as a function of time along the unit axis 412 for a given angular orientation of the initial mould unit 408 (see FIG. 4) with respect to the central sprue 404 (see FIG. 4). Further, an angle A1 defined between a normal 606 to the curvature 602 of the liquidus isotherm 604 and the unit axis 412 is determined.

Furthermore, using the thermal model, a disposition of the primary growth direction D1 of the seed crystal 428 (see FIG. 5) for the given angular orientation is determined if the normal 606 to at least one liquidus isotherm 604 from the plurality of liquidus isotherms 604 is inclined to the unit axis 412 by the angle A1 greater than 15 degrees and if the at least one liquidus isotherm 604 slopes upwards towards an upper end 421 (see FIG. 5) of the component mould 422 (see FIG. 5). Thus, based on the thermal model, if the normal 606 to the liquidus isotherms 604 deviates from the unit axis 412 by greater than 15 degrees frequently, it implies that curvatures 602 of the one or more liquidus isotherms 604 are steep, then it is advisable that the dendrites converge on to the mould wall 424, rather than diverge. This is from the perspective of mitigating the formation and subsequent stabilisation of the secondary grains. In the optimum orientation, a number of instances where the normal 606 to at least one liquidus isotherm 604 from the plurality of liquidus isotherms 604 is inclined to the unit axis 412 by the angle A1 greater than 15 degrees is minimum and a number of instances where the at least one liquidus isotherm 604 slopes upwards towards the upper end 421 of the component mould 422 is minimum. Thus, if the primary growth direction D1 of the seed crystal 428 is not angled away from the mould wall 424 or if the primary growth direction D1 of the seed crystal 428 forms a diverging disposition with the mould wall 424, the initial mould unit 408 is theoretically rotated to dispose the initial mould unit 408 at a second given angular orientation, and so on, until the optimal angular orientation O1 is obtained.

Referring again to FIGS. 4 and 5, the initial mould unit 408 is rotated about the unit axis 412, such that the initial mould unit 408 is disposed in the optimal angular orientation O1 relative to the central sprue 404. Once the initial mould unit 408 is disposed at the optimal angular orientation O1, the refractory mould unit 418 is formed. Thus, the refractory mould unit 418 is also disposed in the optimal angular orientation O1 relative to the central sprue 404. Further, in the optimal angular orientation O1 of the refractory mould unit 418, the primary growth direction D1 of the seed crystal 428 is angled away from the mould wall 424, thereby forming a converging disposition with the mould wall 424 in the first region 425 of the mould wall 424 facing the central sprue 404 and a diverging disposition with the mould wall 424 in the second region 427 of the mould wall 424 facing the mould heater 430. It should be noted that the second region 427 is in direct line of sight of the mould heater 430 and experiences direct radiation, whereas the first region 425 experiences radiation shadowing which accounts for the shape of the liquidus isotherms 604.

Further, each mould unit 408 may be sequentially rotated so that the resulting liquidus isotherms 604 (as shown in FIG. 6) are either flat, or are steep and curve upwards, so that the primary growth direction D1 (see FIG. 6) of the seed crystal 428 forms the converging disposition with the mould wall 424 in the first region 425 of the mould wall 424. Moreover, when the seed crystal 428 is received within the seed holder 422, the primary growth direction D1 of the seed crystal 428 forms the converging disposition with the mould wall 424 in the first region 425 of the mould wall 424. Thus, according to the present disclosure, it is imperative to ensure that when the liquidus isotherms 604 have steep upwards curvature, the dendrites form the converging disposition with the mould wall 424 in the first region 425 of the mould wall 424 to prevent formation and stabilization of secondary grains.

Figure 7:
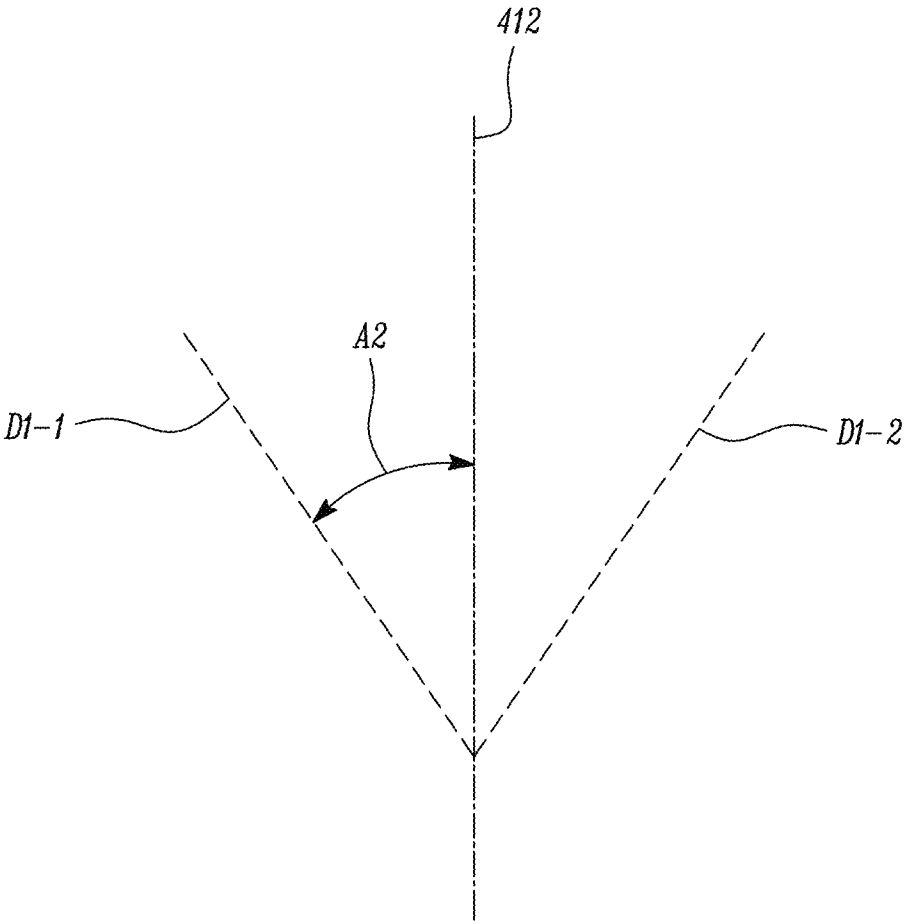
FIG. 7 is a schematic view illustrating a relationship between a unit axis for the refractory mould unit and a primary growth direction of a seed crystal, according to another embodiment of the present disclosure.

FIG. 7 illustrates another embodiment of the present disclosure. In this embodiment, a primary growth direction D1-1 of the seed crystal 428 (see FIG. 5) is independent of an orientation of the initial mould unit 408 (see FIG. 4). In other words, the embodiment illustrated in FIG. 7 is applicable to components where the primary growth direction D1-1 of the seed crystal 428 is not fixed. In such embodiments, the seed crystal 428 may be disposed within the seed holder 422 (see FIG. 5), such that the primary growth direction D1-1 of the seed crystal 428 is from 0 degree to 4 degrees with respect to the unit axis 412. In other words, the seed crystal 428 is disposed in the seed holder 422 such that an angle A2 is defined between the primary growth direction D1-1 and the unit axis 412. Further, a value of the angle A2 may be between 0 degree to 4 degrees. It should be noted that, as the primary growth direction D1-1 is not fixed, the seed crystal 428 may have any other primary growth direction, such as, a primary growth direction D1-2. However, the primary growth direction D1-2 may be inclined by 0 degree to 4 degrees with respect to the unit axis 412. Therefore, the seed crystal 428 may be disposed within the seed holder 422, such that the primary growth direction D1-1 of the seed crystal 428 lies within an imaginary cone defined around the unit axis 412 with a cone half angle equal to the angle A2.

Figure 8:
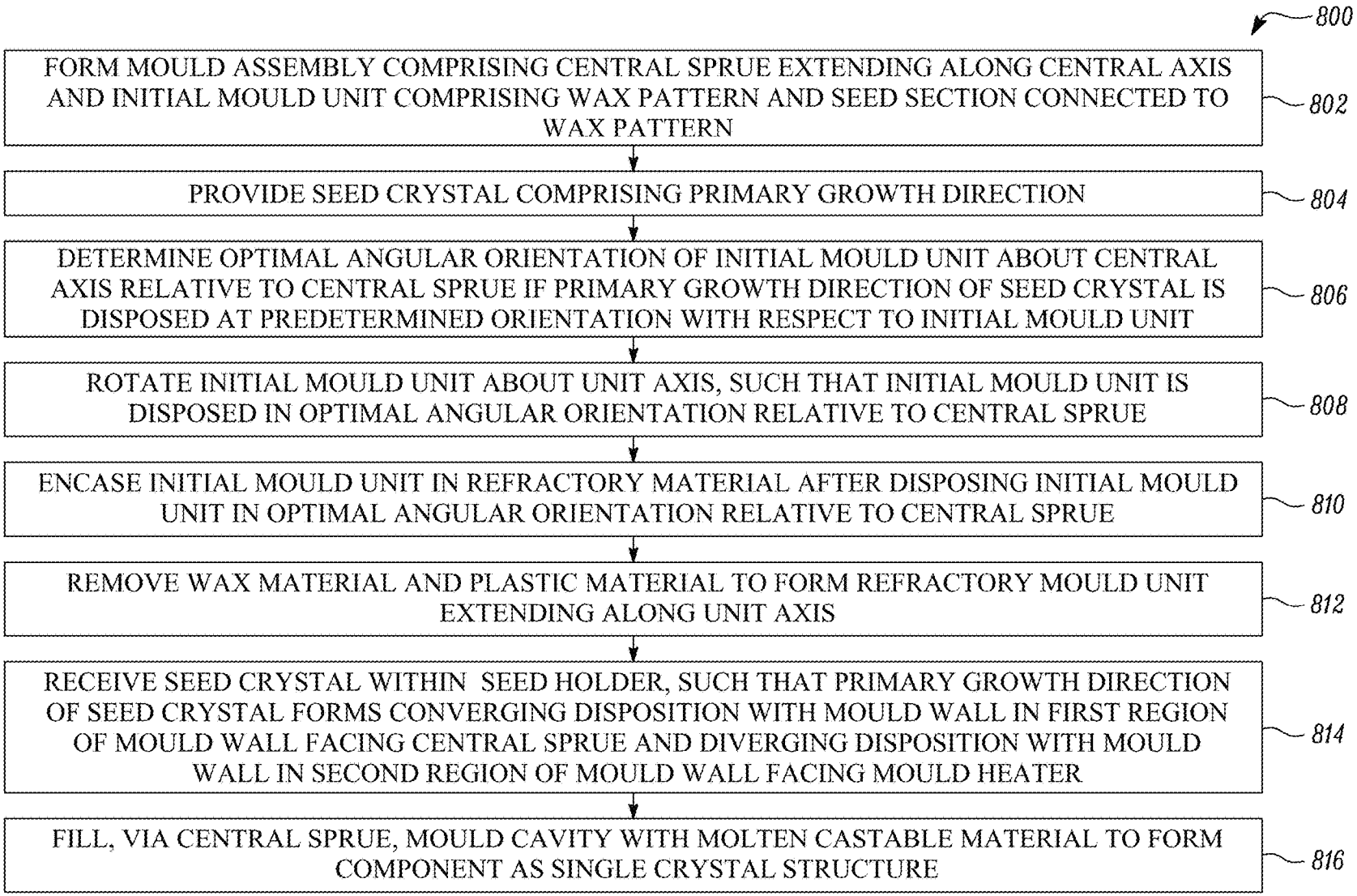
FIG. 8 is a flowchart for a method for manufacturing the component, according to an embodiment of the present disclosure.

FIG. 8 illustrates a flowchart for a method 800 of manufacturing the component 100. Referring to FIGS. 1 to 6, and FIG. 8, at step 802, the mould assembly 402 is formed. The mould assembly 402 includes the central sprue 404 extending along the central axis 406 and the initial mould unit 408 including the wax pattern 414 and the seed section 416 connected to the wax pattern 414. The wax pattern 414 is made of the wax material and the seed section 416 is made of the plastic material. The initial mould unit 408 extends along the unit axis 412 parallel to the central axis 406. The initial mould unit 408 is rotatable about the unit axis 412 with respect to the central sprue 404. The wax pattern 414 and the seed section 416 are formed as the single integral component. Further, the component 100 is the blade 102 of the gas turbine engine 10. The blade 102 manufactured by the method 800 of the first aspect may have reduced surface defects and may have improved conformance to the specifications of the blade 102. Thus, the blade 102 may achieve desired operational performance due to conformance to the specifications.

At step 804, the seed crystal 428 including the primary growth direction D1 is provided. At step 806, the optimal angular orientation O1 of the initial mould unit 408 about the central axis 406 relative to the central sprue 404 is determined if the primary growth direction D1 of the seed crystal 428 is disposed at the predetermined orientation with respect to the initial mould unit 408. For determining the optimal angular orientation O1 of the initial mould unit 408, using the thermal model, the curvatures 602 of the plurality of liquidus isotherms 604 of the molten castable material as a function of time are determined for the given angular orientation of the initial mould unit 408 with respect to the central sprue 404. Further, using the thermal model, the disposition of the primary growth direction D1 of the seed crystal 428 for the given angular orientation is determined if the normal 606 to at least one liquidus isotherm 604 from the plurality of liquidus isotherms 604 is inclined to the unit axis 412 by the angle A1 greater than 15 degrees and if the at least one liquidus isotherm 604 slopes upwards towards the upper end 421 of the component mould 422. Furthermore, the given angular orientation is varied and the curvatures 602 of the plurality of liquidus isotherms 604 of the molten castable material as well as the disposition of the primary growth direction D1 of the seed crystal 428 for the given angular orientation is determined till the optimal angular orientation O1 is obtained. Further, the initial mould unit 408 is positioned on the carousel 410 including the central sprue 404 prior to rotating the initial mould unit 408 about the unit axis 412. In the optimum orientation, the number of instances where the normal 606 to at least one liquidus isotherm 604 from the plurality of liquidus isotherms 604 is inclined to the unit axis 412 by the angle A1 greater than 15 degrees is minimum and the number of instances where the at least one liquidus isotherm 604 slopes upwards towards the upper end 421 of the component mould 422 is minimum. Thus, from amongst a multitude of possible angular orientations obtained iteratively through theoretical rotation of the initial mould unit 408 on the carousel 410 and calculations of the curvatures 602 of the liquidus isotherms 604 using the thermal model, the optimal angular orientation O1 of the initial mould unit 408 can be deduced which may reduce the probability of formation of secondary grains.

At step 808, the initial mould unit 408 is rotated about the unit axis 412, such that the initial mould unit 408 is disposed in the optimal angular orientation O1 relative to the central sprue 404. Due to the positioning of the initial mould unit 408 in the optimal angular orientation O1, the primary growth direction D1 of the seed crystal 428 is angled away from the mould wall 424, thereby forming the converging disposition with the mould wall 424 in the first region 425 which may reduce a probability of formation of secondary grains. Thus, the method 800 of obtaining the optimal angular orientation O1 of the initial mould unit 408 for any blade geometry may minimise the formation and subsequent stabilisation of the secondary grains, thereby reducing a possibility of non-conformance to the specifications of the component 100.

At step 810, the initial mould unit 408 is encased in the refractory material after disposing the initial mould unit 408 in the optimal angular orientation O1 relative to the central sprue 404. The refractory material is the ceramic slurry.

At step 812, the wax material and the plastic material is removed to form the refractory mould unit 418 extending along the unit axis 412. The refractory mould unit 418 includes the component mould 420 corresponding to the wax pattern 414 and the seed holder 422 corresponding to the seed section 416. The component mould 420 includes the mould wall 424 defining the mould cavity 426 that is disposed in fluid communication with the seed holder 422 and the central sprue 404. Each of the component mould 420 and the seed holder 422 is made of the refractory material. The refractory mould unit 418 is disposed in the optimal angular orientation O1 relative to the central sprue 404. In the optimal angular orientation O1 of the refractory mould unit 418, the primary growth direction D1 of the seed crystal 428 is angled away from the mould wall 424, thereby forming the converging disposition with the mould wall 424 in the first region 425 of the mould wall 424 facing the central sprue 404 and the diverging disposition with the mould wall 424 in the second region 427 of the mould wall 424 facing the mould heater 430.

At step 814, the seed crystal 428 is received within the seed holder 422, such that the primary growth direction D1 of the seed crystal 428 forms the converging disposition with the mould wall 424 in the first region 425 of the mould wall 424 and the diverging disposition with the mould wall 424 in the second region 427 of the mould wall 424. At step 816, the mould cavity 426 is filled with the molten castable material via the central sprue 404 to form the component 100 as the single crystal structure.

Referring now to FIGS. 4, 5, 7, and 8, in some embodiments, the method 800 includes a step of determining if the primary growth direction D1-1 of the seed crystal 428 is independent of the orientation of the initial mould unit 408. Further, the method 800 includes a step of removing the wax material and the plastic material to form the refractory mould unit 418 extending along the unit axis 412 without rotating the initial mould unit 408 to the optimal angular orientation O1 relative to the central sprue 404. The method 800 further includes a step of receiving the seed crystal 428 within the seed holder 422, such that the primary growth direction D1-1 of the seed crystal 428 is from 0 degree to 4 degrees with respect to the unit axis 412. Thus, when no preferred axial orientation is required for the component 100, the primary growth direction D1-1 of the seed crystal 428 may be between 0 degree and 4 degrees with respect to the unit axis 412, which may reduce the formation of secondary grains and reduce non-conformance to the specifications of the component 100.

It will be understood that the invention is not limited to the embodiments above described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A method of manufacturing a component, the method comprising the steps of:

forming a mould assembly comprising a central sprue extending along a central axis and an initial mould unit comprising a wax pattern and a seed section connected to the wax pattern, the wax pattern being made of a wax material and the seed section being made of a plastic material, the initial mould unit extending along a unit axis parallel to the central axis, wherein the initial mould unit is rotatable about the unit axis with respect to the central sprue;

providing a seed crystal comprising a primary growth direction;

determining an optimal angular orientation of the initial mould unit about the central axis relative to the central sprue if the primary growth direction of the seed crystal is disposed at a predetermined orientation with respect to the initial mould unit;

rotating the initial mould unit about the unit axis, such that the initial mould unit is disposed in the optimal angular orientation relative to the central sprue;

encasing the initial mould unit in a refractory material after disposing the initial mould unit in the optimal angular orientation relative to the central sprue;

removing the wax material and the plastic material to form a refractory mould unit extending along the unit axis, the refractory mould unit comprising a component mould corresponding to the wax pattern and a seed holder corresponding to the seed section, the component mould comprising a mould wall defining a mould cavity that is disposed in fluid communication with the seed holder and the central sprue, wherein each of the component mould and the seed holder is made of the refractory material, wherein the refractory mould unit is disposed in the optimal angular orientation relative to the central sprue, and wherein, in the optimal angular orientation of the refractory mould unit, the primary growth direction of the seed crystal is angled away from the mould wall, thereby forming a converging disposition with the mould wall in a first region of the mould wall facing the central sprue and a diverging disposition with the mould wall in a second region of the mould wall facing a mould heater;

receiving the seed crystal within the seed holder, such that the primary growth direction of the seed crystal forms the converging disposition with the mould wall in the first region of the mould wall and the diverging disposition with the mould wall in the second region of the mould wall; and filling, via the central sprue, the mould cavity with molten castable material to form the component as a single crystal structure.

2. The method of claim 1, wherein determining the optimal angular orientation of the initial mould unit comprises the steps of:

a) determining, using a thermal model, curvatures of a plurality of liquidus isotherms of the molten castable material as a function of time along the unit axis for a given angular orientation of the initial mould unit with respect to the central sprue;

b) determining, using the thermal model, a disposition of the primary growth direction of the seed crystal for the given angular orientation if a normal to at least one liquidus isotherm from the plurality of liquidus isotherms is inclined to the unit axis by an angle greater than 15 degrees and if the at least one liquidus isotherm slopes upwards towards an upper end of the component mould; and c) repeating steps a) and b) by varying the given angular orientation till the optimal angular orientation is obtained.

3. The method of claim 1, further comprising:

determining that the primary growth direction of the seed crystal is independent of an orientation of the initial mould unit;

removing the wax material and the plastic material to form the refractory mould unit extending along the unit axis without rotating the initial mould unit to the optimal angular orientation relative to the central sprue; and receiving the seed crystal within the seed holder, such that the primary growth direction of the seed crystal is from 0 degree to 4 degrees with respect to the unit axis.

4. The method of claim 1, further comprising positioning the initial mould unit on a carousel comprising the central sprue prior to rotating the initial mould unit about the unit axis.

5. The method of claim 1, wherein the refractory material is a ceramic slurry.

6. The method of claim 1, wherein the wax pattern and the seed section are formed as a single integral component.

7. The method of claim 1, wherein the component is a blade of a gas turbine engine.

* * * * *